US010151562B1

(12) United States Patent
Hollars

(10) Patent No.: US 10,151,562 B1
(45) Date of Patent: Dec. 11, 2018

(54) SIGHT SYSTEM FOR PROJECTILE-LAUNCHING DEVICES

(71) Applicant: Anthony Hollars, Tucson, AZ (US)

(72) Inventor: Anthony Hollars, Tucson, AZ (US)

( * ) Notice: Subject to any disclaimer, the term of this patent is extended or adjusted under 35 U.S.C. 154(b) by 308 days.

(21) Appl. No.: 14/989,314

(22) Filed: Jan. 6, 2016

Related U.S. Application Data

(60) Provisional application No. 62/100,363, filed on Jan. 6, 2015.

(51) Int. Cl.
*F41G 1/467* (2006.01)

(52) U.S. Cl.
CPC ..... *F41G 1/467* (2013.01)

(58) Field of Classification Search
CPC ... F41G 1/467; F41G 1/54; F41G 1/35; F41G 1/44; F41G 1/545; F41G 1/08; F41G 1/345; F41G 1/473
USPC ..... 33/265
See application file for complete search history.

(56) References Cited

U.S. PATENT DOCUMENTS 3,013,336 A * 12/1961 Pennington ..... F41G 1/467 33/265
5,092,052 A * 3/1992 Godsey ..... F41G 1/467 33/265
5,975,069 A * 11/1999 Hamm ..... F41G 1/467 33/265
6,119,672 A * 9/2000 Closson ..... F41G 1/467 33/265
6,134,794 A * 10/2000 Raukola ..... F41G 1/467 33/265
6,463,665 B1 * 10/2002 Gomez-Vazquez ..... F41G 1/467 33/265
6,526,666 B1 * 3/2003 Lastinger, Jr. ..... F41B 5/14 33/265
2002/0100177 A1 * 8/2002 Savage ..... F41G 1/467 33/265
2002/0112358 A1 * 8/2002 Savage ..... F41G 1/467 33/265
2010/0115778 A1 * 5/2010 Gorsuch ..... F41G 1/467 33/265

* cited by examiner

*Primary Examiner* — Yaritza Guadalupe
(74) *Attorney, Agent, or Firm* — Dale F. Regelman; Grossman, Tucker, Perreault & Pfleger, PLLC

(57) ABSTRACT

An archery sight with a sight line that is capable of movement on an arced path along a radius that approximates the distance between an archer's eyeball and the sight. The arc is the part of the radius that includes the portion needed to position the sight accurately to compensate for an arrow's trajectory from the shortest to longest range that the bow is capable of. This results in a sight line that always aligns perfectly with an archer's eye.

15 Claims, 6 Drawing Sheets

SIGHT SYSTEM FOR PROJECTILE-LAUNCHING DEVICES

CROSS REFERENCE

This application claims priority to U.S. Provisional Patent Application No. 62/100,363 filed Jan. 6, 2015, the specification of which is incorporated herein in its entirety by reference.

FIELD OF THE INVENTION

The present invention relates to sights for bows and crossbows and other similar projectile-launching devices or the like.

BACKGROUND OF THE INVENTION

Sights for accurately placing a projectile (such as an arrow) into a target have evolved from ones using instinct and practice to very complex mechanical devices. For example, in primitive archery, a bow was very simple and had a limited effective range. The use of a device to aim the bow was not needed. As materials and design became better and bows became capable of much faster arrow speeds and range, sighting devices became popular. Prior art sights share come common features: they have a rear peep sight mounted in the bowstring or a rear sight mounted to the bow, and they use these rear sights to align with a front sight to aim at the target. An example of a rear sight reference is a peep sight woven into the bowstring. Without wishing to limit the present invention to any theory or mechanism, it is believed that the configuration with the peep sight woven into the bowstring may present challenges, for example the small aperture may cause difficulty in seeing targets in low-light settings. And, it may cause the eye to have to focus at three ranges: just in front of the eyeball, at the front sight, and at the target some yards away. The use of multiple reference points may lead to inaccuracies (e.g., one or more of the reference points end up out of focus). In some cases, the front sight has multiple pins stacked vertically. These sights may cause the archer to move the drawn anchor position to view the pins for different ranges. Other types of sights have a single sight line but with multiple reference points, wherein the sight line is moved vertically to compensate for different ranges (see FIG. 1 showing an example of the prior art), e.g., to compensate for distance or a movable front sight that can be placed at the correct height for the range. While these may be effective for a single range or narrow set of distances, they may present challenges because of the large movement of the sight required to compensate for the trajectory of an arrow.

There have been attempts to have a better sight line in archery. Some examples include peep sights for bowstrings that have multiple apertures spaced apart to allow the front sights to be used at multiple ranges. With this type of sight, the archer must move the shooting stance and anchor point of the bow at full draw, which can result in inaccuracy.

Many attempts to allow the use of a front and rear sight mounted to the handle as opposed to using a peep sight as the rear sight reference have been introduced. These often do not provide the alignment of the sight line to the archers eyeball over a large range of distance settings. Some have a movable rear sight and some have a movable front sight. These are usually movable with a parallelogram style, pivot, or vertical, adjustment (Examples are the fine line rear sight by ProMaster™ and the Hind Sight™ by Precision Sighting Systems.)

There are also numerous sights that allow for rifle sights, telescopic sight or holographic sights to be used in archery. They can be used in one narrow range such as a target shooting at a specific yardage, but oftentimes these do not allow the sight to be used over a range of distances without the movement of the sight causing the misalignment of the sight line between the archers eye and the target so significantly that the archers anchor point at full draw and stance are greatly affected compromising accuracy (e.g., Messer Optics,™ Opti-Mount™).

The present invention features a sight system. The system of the present invention is capable of moving along an arced track along a radius that approximates the distance between an archers eyeball. The arc described is a portion of the radius that includes the portion needed to position the sight accurately to compensate for an arrow's trajectory from the shortest to longest range that the bow is capable of. The present invention may eliminate the need for a peep sight because the front and rear reference points are attached and rotate about the arc together, allowing the archer to maintain proper shooting position (to improve accuracy). Additionally, the present invention will allow the use of any type of sight from traditional rifle sights to modern holographic sights, telescopic sights or pins because matching the arc of rotation of the sight to the distance from the sight to the archers eyeball may eliminate the need for large vertical movement of the archer's drawn shooting position and anchor point to compensate for longer ranges. It will provide a simple, easy to use sight with great accuracy. Without wishing to limit the present invention to any theory or mechanism, unlike prior art sights, the present invention results in a sight line that is expected to always align perfectly with an archer's eye.

The invention will comprise a mounting system to a bow with a mechanism allowing the mounted sight line to move along the arced track such that the sight line is expected to always align perfectly with the archer's eye and the target (see FIG. 5). Note that other sights do not allow a perfect alignment with the archer's eye throughout the range of the bow; they cause the archer to move the bow substantially from the proper shooting position and anchor point during full draw to align the sight with the target.

In some embodiments, the sight line is movable both for and aft perpendicular to the tangent of the arc as long range shooters will want a longer sight line moved forward for increased accuracy at long ranges. Hunters on the other hand may want a more compact sight line for carrying a bow in the brush.

Oftentimes the prior art sights (regardless of type) are made in a "one size fits all bows and archers" configuration. Because archers vary in stature, the arc track of the present invention may be made to be adjustable in sizes to accommodate all archers. In some embodiments the radius of the arced track and/or the pivot mounting may be made to vary in sizes. In some embodiments, the varying radius arcs along with adjustment in the mounting to the bow handle can accommodate any size archer or draw length.

Without wishing to limit the present invention to any theory or mechanism, it is believed that prior art designs can be set up to align perfectly with the archers eye at one distance but the sight line can deviate with changing the position of the sight to accommodate a large range of distances. Sights have been made to have many styles of pivots and adjustments to move the sights, but they cannot simulate the movement along the arc track on the present invention. The present invention can be made to follow a track or use multiple pivots to simulate the arced movement.

The sight system of the present invention is not limited to archery (e.g., bow, crossbow) applications. In some embodiments, the sight system of the present invention can be adapted for rifles and guns, slingshot systems, toys, or any other appropriate projectile-launching system.

Further, with the present invention, any appropriate type of sighting device can be used such as iron rifle sights, telescopic sights, holographic sights or typical pin sights used in archery (e.g., using the present invention, it does matter which type of sight is used because the sight line will theoretically be perfectly aligned to the archers eye.

SUMMARY OF THE INVENTION

The present invention features an archery sight system that is adjustable for distance of a target along an arc that always aligns a sight line perfectly with an archer's eye so that use of any type of sight is allowable without moving the correct draw position and nock point allowing for better accuracy.

The present invention features a sight system for a projectile-launching device. In some embodiments, the sight system comprises a sight line support and a curved arc track. In some embodiments, the distal end of the sight line support is slidably attached to the arc track via a moveable attachment such that the sight line support can move in at least a first direction and a second opposite direction along at least a portion of the ark track.

In some embodiments, the sight line support is slidably attached to the arc track such that at any position the sight line support occupies along the arc track, the sight line support is perpendicular to a tangent of the arc track, the tangent being a line tangent to the arc track at a point formed where the sight line support intersects with the arc track.

In some embodiments, the projectile-launching device comprises a bow, and the arc track is attached to the bow via a mount assembly. In some embodiments, the mount assembly comprises a bolt adapted to engage threaded holes within the bow.

In some embodiments, a line L is formed from (a) a point P, point P being where the sight line support intersects with the arc track and (b) point C, point C being a center of a circle formed by the arc track, wherein line L is equal for any position the sight line support occupies along the arc track (see FIG. 6). In some embodiments, the arc track has a radius of curvature that is equal to line L. In some embodiments, point C is where an archer aligns his eyeball.

In some embodiments, the movable attachment comprises a roller. In some embodiments, a front sight is disposed on a distal end of the sight line support and rear sight is disposed on a proximal end of the sight line support. In some embodiments, the front sight and the rear sight comprise iron rifle sights, telescopic sights, holographic sights, or pin sights.

The present invention also features a sight system comprising a sight line support and a pivot system, wherein the pivot system simulates a track, e.g., a track along which the sight line support can slide.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DETAILED DESCRIPTION OF THE INVENTION

Figure 1:
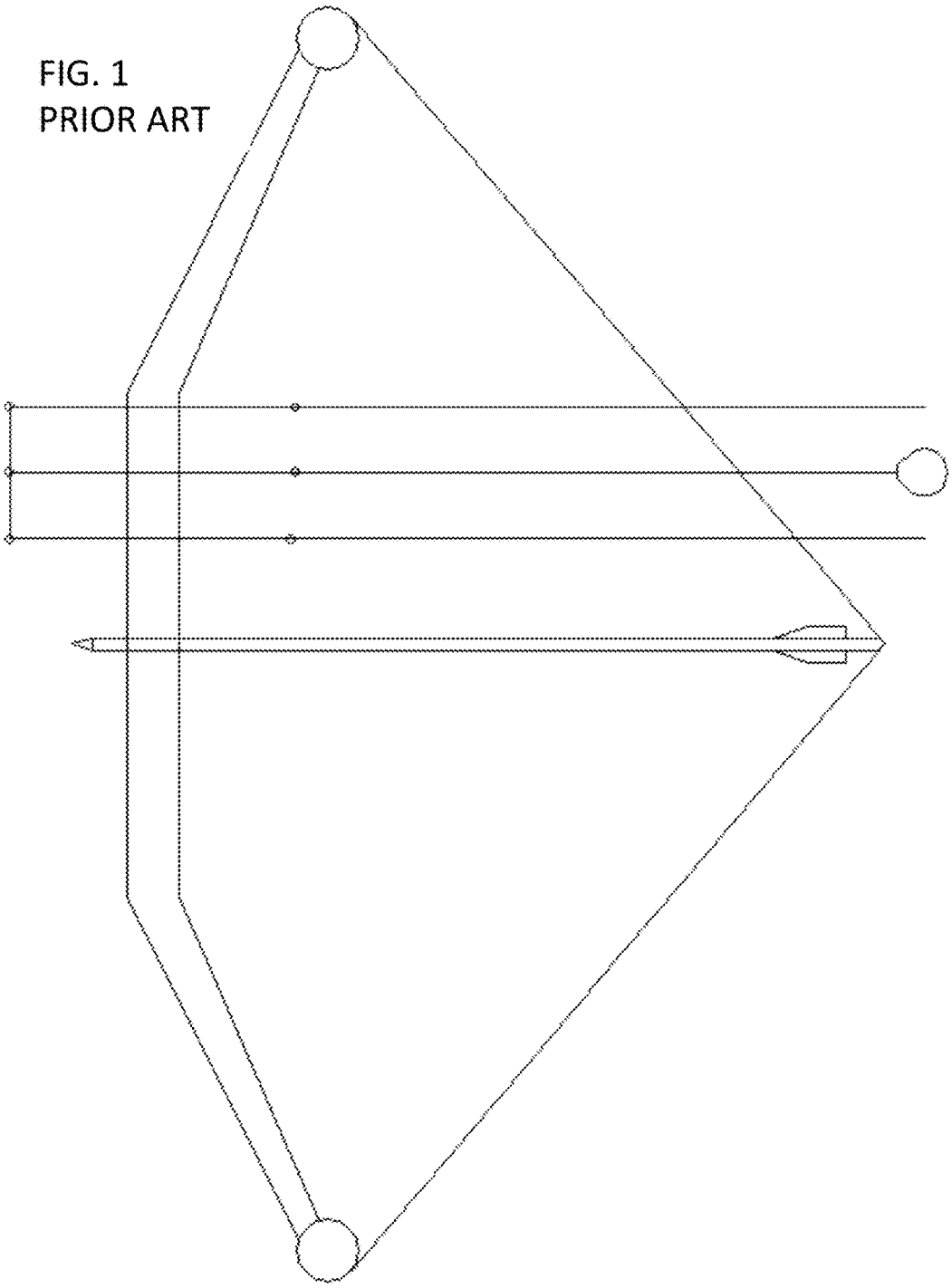
FIG. 1 PRIOR ART
FIG. 1 (prior art) shows a lack of alignment with the eyeball with vertical movement (if a particular prior art sight is used—note that a sight is not shown).
Figure 2:
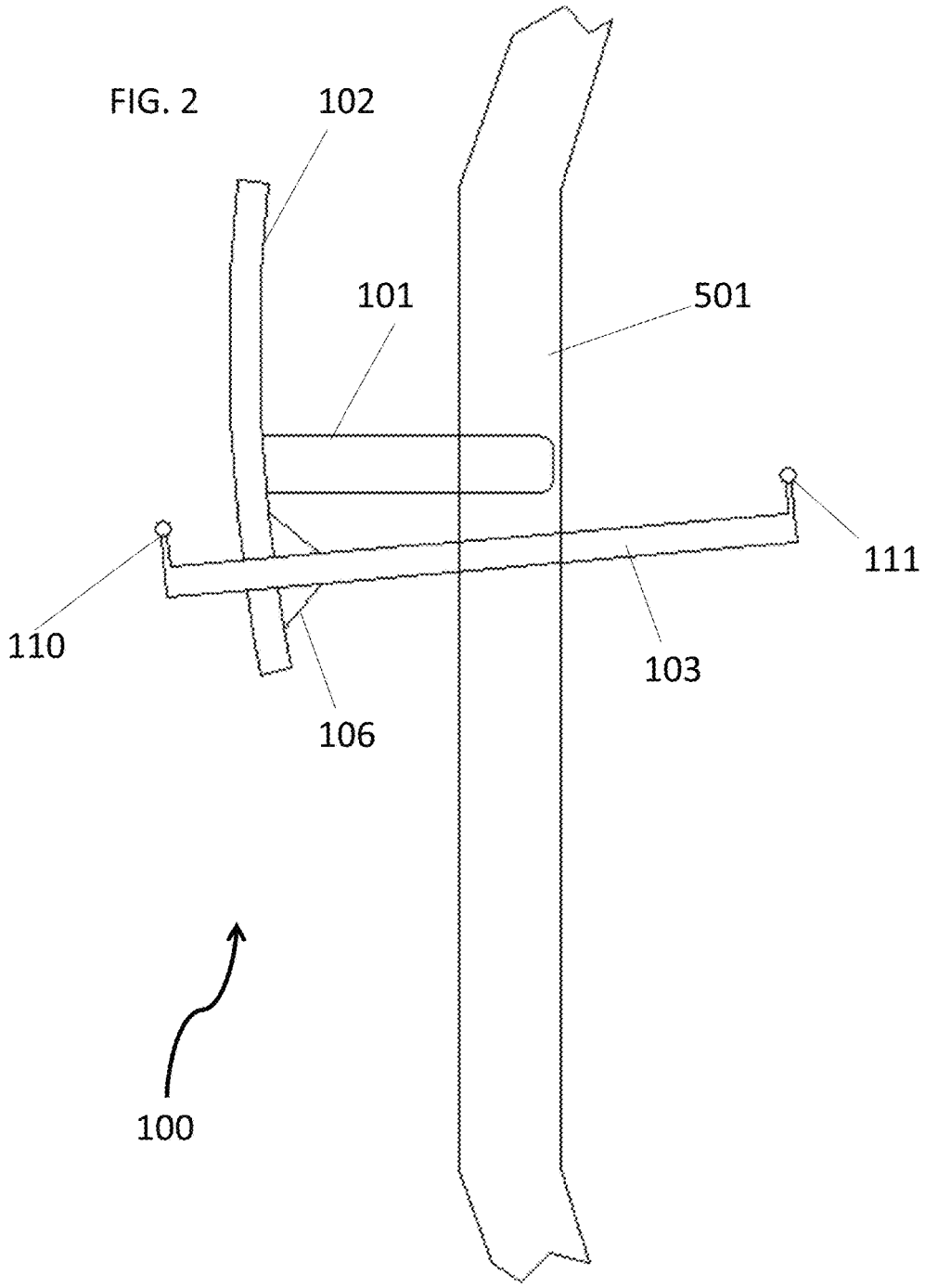
FIG. 2 shows a side view of a sight system of the present invention.
Figure 3:
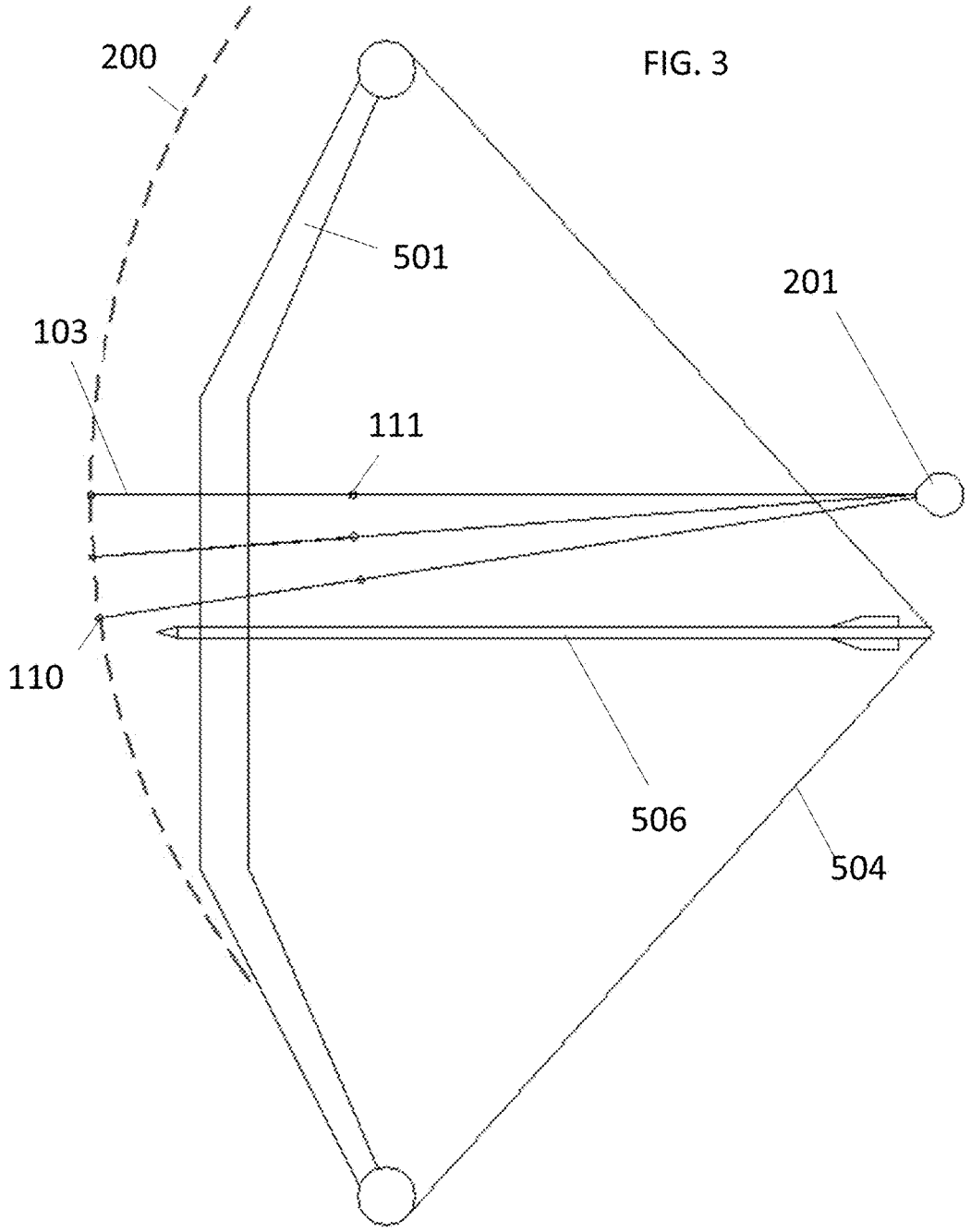
FIG. 3 shows a diagram illustrating lines of sight of the archer's eye using the system of the present invention.
Figure 4:
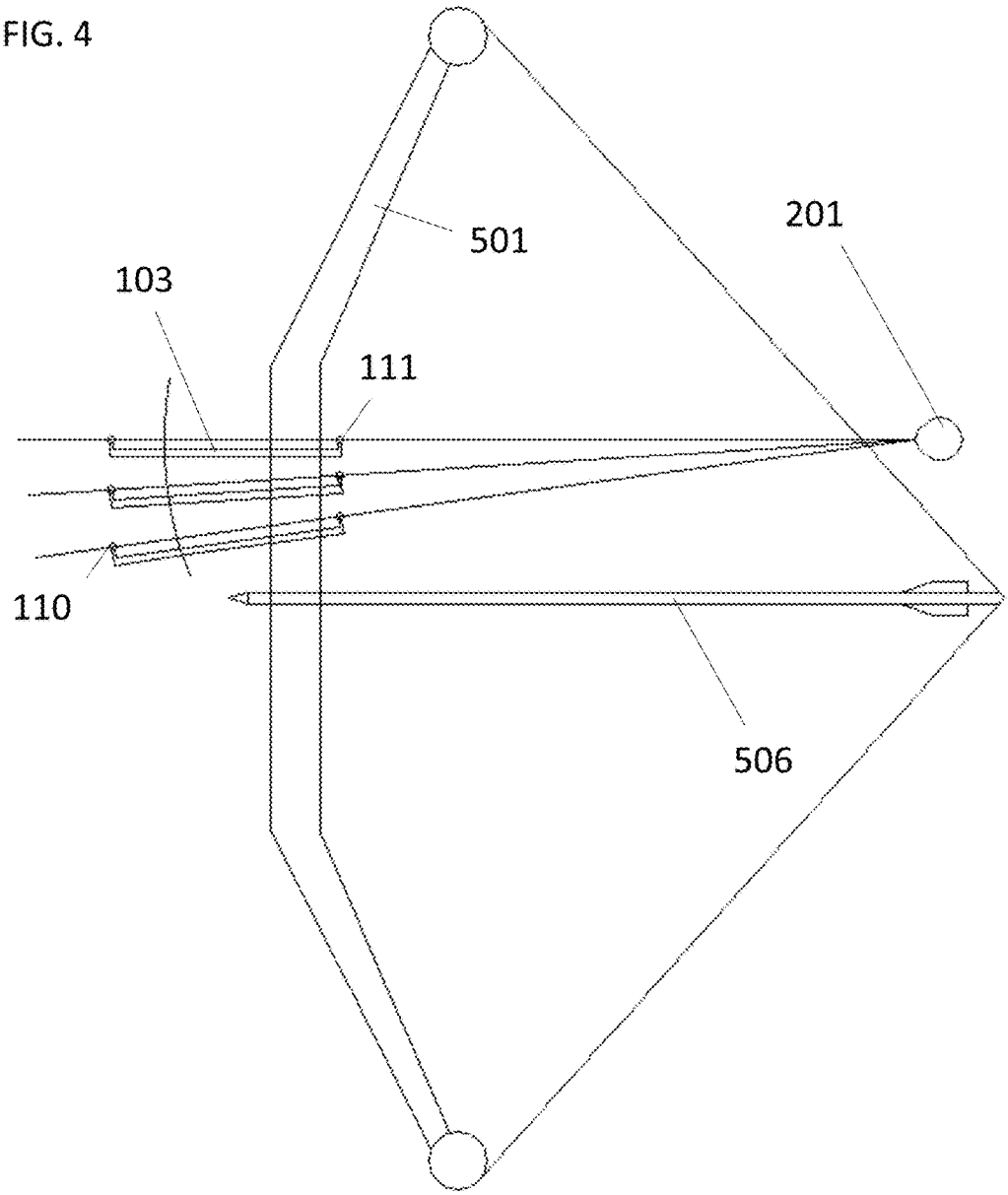
FIG. 4 shows a diagram illustrating lines of sight of the archer's eye using the system of the present invention.
Figure 5:
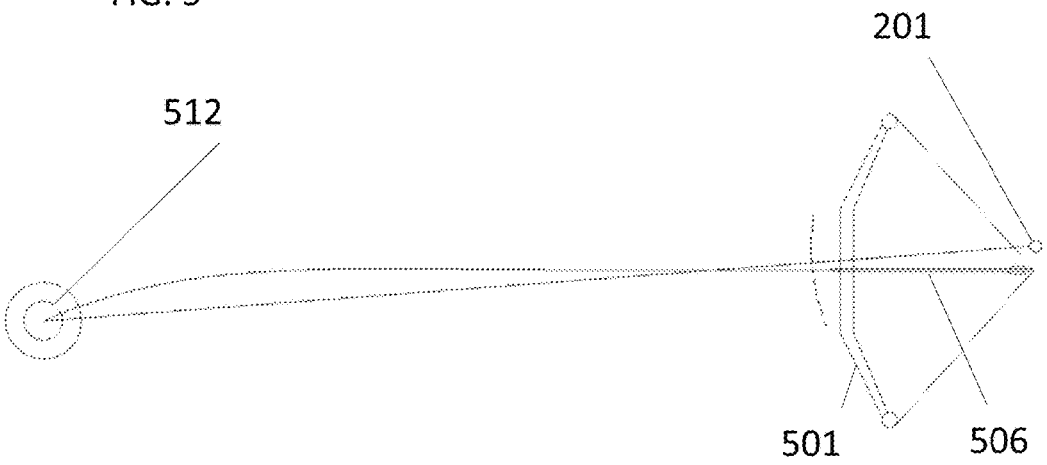
FIG. 5 shows a schematic representation of a line of sight (from the eyeball to the target) and the trajectory of the arrow.
Figure 6:
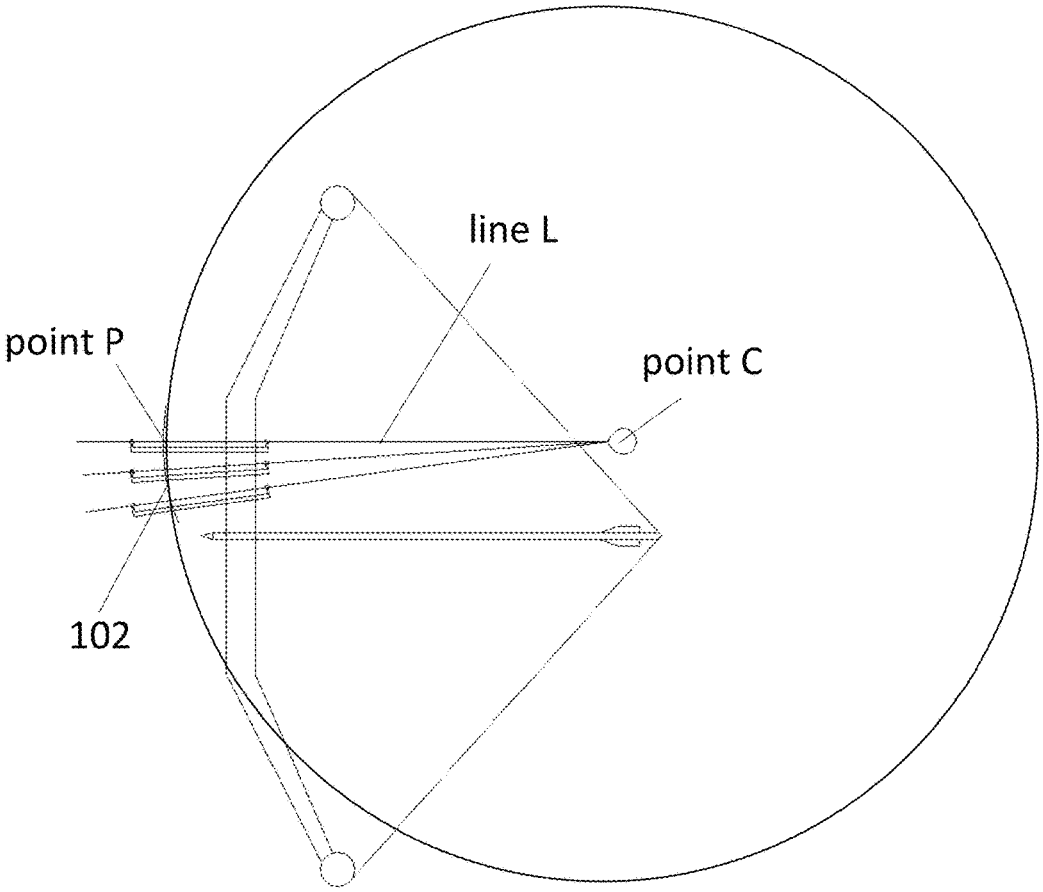
FIG. 6 shows a schematic view of a circle formed by the arc track. (Note: circle and other components are not necessarily drawn to scale.)

Following is a list of elements corresponding to a particular element referred to herein:

100 sight system
101 mount assembly
102 arc track
103 sight line support
106 attachment
110 front sight
111 rear sight
201 eyeball
501 bow handle
504 bowstring
506 arrow
512 target Referring now to FIGS. 2-6, the present invention features a sight system (100) for bows, crossbows, or other projectile-launching devices. The sight system (100) of the present invention allows for accurate alignment of an arrow for reaching a target. For reference, FIG. 5 shows a line of sight extending from the eyeball (201) of an archer to a target (512) with the arrow (506) in position as shown.

The sight system (100) of the present invention comprises a mount assembly (101) having a proximal end that is attached or can be attached to a bow (501) or other appropriate component and a distal end (the distal end being opposite the proximal end). Disposed on the distal end of the mount assembly (101) is an arc track (102). The arc track (102) has a radius of curvature and arc length. The arc length and radius of curvature can be determined as appropriate for the application.

The system (100) of the present invention further comprises a sight line support (103), which is slidably attached to the arc track (102) via a movable attachment (106). In some embodiments, the movable attachment (106) can be rollers, a V-shaped follower, or other appropriate component that allows movement or sliding of the sight line support (103) along the arc track (102). The sight line support (103) can move in at least a first direction and a second (e.g., opposite) direction along the arc track (102), e.g., upwardly and downwardly along the arc track (102).

In some embodiments, the sight line support (103) is supported on the movable attachment so that it can be moved to a position along the arc track (102) to allow the sight line to be positioned correctly for any distance the archer chooses. In some embodiments, the mount assembly (101) is rigidly attached to the bow handle (501). In some embodiments, the mount assembly (101) comprises bolts that fit threaded holes pre-formed in the handle of a typical bow, however the present invention is not limited to these components and includes any other appropriate component for attaching the arc track (102) to the bow (501). In some embodiments, the sight line support (103) is movably attached so that it is always perpendicular to a tangent of the arc track (102) in any position.

In some embodiments, the sight line support (103) comprises a front sight pin (110) disposed on the distal end of the sight line support (103) and rear sight pin (111) disposed on the proximal end of the sight line support (103). The sight pins (110, 111) may comprise any appropriate sighting device including but not limited to iron rifle sights, telescopic sights, holographic sights, or typical pin sights used in archery.

In some embodiments, the arc track (102) has a radius of curvature that is same or similar to the distance between the arc track (102) and a point behind the bow (e.g., a point that is where the archer's eyeball will be when in use). This may allow for the sight line support (103) to align with the archer's eye (e.g., unlike some prior art sights that move along pivots or vertical tracks to adjust for range).

FIG. 3 and FIG. 4 show a bow (501) (e.g., comprised of a handle, a pair of limbs, a bowstring (504) and an arrow (506) ready to be released. The sight line support (103) is shown in multiple portions along the arc (200) formed by the arc track (102) (e.g., the radius at the distance from the track (102) to the archers eyeball (201)). The different positions represent the sight line support (103) placed for different ranges of shooting from further (lower sight line represented) to closer (top sight line represented).

In FIG. 3 and FIG. 4, the front sight (110) and rear sight (111) in each of the sight line examples are shown in alignment with the archer's eye (201) and the sight line. It is apparent that changing the position of the sight line to accommodate different ranges with the invention result in the sight line always being aligned with the archers eye.

As used herein, the term "about" refers to plus or minus 10% of the referenced number.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way. In some embodiments, the figures presented in this patent application are drawn to scale, including the angles, ratios of dimensions, etc. In some embodiments, the figures are representative only and the claims are not limited by the dimensions of the figures. In some embodiments, descriptions of the inventions described herein using the phrase "comprising" includes embodiments that could be described as "consisting of", and as such the written description requirement for claiming one or more embodiments of the present invention using the phrase "consisting of" is met.

The reference numbers recited in the below claims are solely for ease of examination of this patent application, and are exemplary, and are not intended in any way to limit the scope of the claims to the particular features having the corresponding reference numbers in the drawings.

What is claimed is:

1. An archery sight system (100) comprising a bow, said archery sight system being adjustable for distance to a target, comprising:

a sight line support (103) having a proximal end formed to include a rear sight (110) and a distal end formed to include a front sight (111);

an arcuate member (102); and a mount assembly (101) having a first end attached to said bow;

wherein:

the distal end of the sight line support (103) is attached to the arcuate member (102) such that the sight line support (103) can slide along arcuate member (102) in a first direction or in a second and opposite direction, a second end of the mount assembly (101) is attached to said arcuate member (102);

said arcuate member (102) comprises a radius of curvature;

said radius of curvature is substantially equal to a distance from an archer's eye to said front sight when shooting said bow.

2. A sight system (100) for a projectile-launching device, said sight system (100) comprising:

a. a sight line support (103) having a distal end and a proximal end; and b. an arcuate track (102), wherein the distal end of the sight line support (103) is slidably attached to the arcuate track (102) via a moveable attachment (106) such that the sight line support (103) can move in a first direction and a second opposite direction along at least a portion of the arcuate track;

wherein:

the projectile-launching device comprises a bow (501), and the arcuate track (102) is attached to the bow (501) via a mount assembly (101);

a line L is formed from (a) a point P, point P being where the sight line support (103) intersects with the arc track (102) and (b) point C, point C being a center of a circle formed by the arc track (102), wherein line L is equal for any position the sight line support (103) occupies along the arc track (102).

3. The sight system (100) of claim 2, wherein the sight line support (103) is slidably attached to the arc track (102) such that at any position the sight line support (103) occupies along the arc track, the sight line support (103) is perpendicular to a tangent of the arc track (102), the tangent being a line tangent to the arc track (102) at a point formed where the sight line support (103) intersects with the arc track (102).

4. The sight system (100) of claim 2, wherein the mount assembly (101) comprises a bolt adapted to engage threaded holes within the bow (501).

5. The sight system (100) of claim 2, wherein the arc track (102) has a radius of curvature that is equal to line L.

6. The sight system (100) of claim 5, wherein the front sight (110) and the rear sight (111) comprise iron rifle sights, telescopic sights, holographic sights, or pin sights.

7. The sight system (100) of claim 2, wherein point C is where an archer aligns his eyeball.

8. The sight system (100) of claim 2, wherein the movable attachment (106) comprises a roller.

9. The sight system (100) of claim 2, wherein a front sight (110) is disposed on a distal end of the sight line support (103) and rear sight (111) is disposed on a proximal end of the sight line support (103).

10. A sight system (100), said sight system (100) comprising:

a. a bow (501);

b. an arc track (102) attached to the bow (501) via a mount assembly (101), the arc track (102) is curved; and c. a sight line support (103) having a distal end and a proximal end, wherein the distal end of the sight line support (103) is slidably attached to the arc track (102) via a moveable attachment (106) such that the sight line support (103) can move in at least a first direction and a second opposite direction along at least a portion of the ark track (102), wherein the sight line support (103) is slidably attached to the arc track (102) such that at any position the sight line support (103) occupies along the arc track, the sight line support (103) is perpendicular to a tangent of the arc track (102), the tangent being a line tangent to the arc track (102) at a point formed where the sight line support (103) intersects with the arc track (102); and d. a front sight (110) disposed on the distal end of the sight line support (103) and a rear sight (111) disposed on the proximal end of the sight line support (103).

11. The sight system (100) of claim 10, wherein the mount assembly (101) comprises a bolt adapted to engage threaded holes within the bow (501).

12. The sight system (100) of claim 10, wherein a line L is formed from (a) a point P, point P being where the sight line support (103) intersects with the arc track (102) and (b) point C, point C being a center of a circle formed by the arc track (102), wherein line L is equal for any position the sight line support (103) occupies along the arc track (102).

13. The sight system (100) of claim 12, wherein the arc track (102) has a radius of curvature that is equal to line L.

14. The sight system (100) of claim 10, wherein the movable attachment (106) comprises a roller.

15. The sight system (100) of claim 10, wherein the front sight (110) and the rear sight (111) comprise iron rifle sights, telescopic sights, holographic sights, or pin sights.

* * * * *